US008858242B2

(12) United States Patent
Lin

(10) Patent No.: US 8,858,242 B2
(45) Date of Patent: Oct. 14, 2014

(54) ELECTRONIC DEVICE AND CONNECTING COMPONENT

(75) Inventor: Wei-Cheng Lin, New Taipei (TW)

(73) Assignee: Wistron Corp., New Taipei (TW)

( * ) Notice: Subject to any disclaimer, the term of this patent is extended or adjusted under 35 U.S.C. 154(b) by 293 days.

(21) Appl. No.: 13/600,167

(22) Filed: Aug. 30, 2012

(65) Prior Publication Data

US 2013/0309882 A1 Nov. 21, 2013

(30) Foreign Application Priority Data

May 21, 2012 (TW) ..... 101117972 A

(51) Int. Cl.
*H01R 13/648* (2006.01)

(52) U.S. Cl.
USPC ..... 439/95; 439/108

(58) Field of Classification Search
USPC ..... 439/95, 108
See application file for complete search history.

(56) References Cited

U.S. PATENT DOCUMENTS

| | | | | |
|---|---|---|---|---|
| 5,160,806 | A * | 11/1992 | Harada et al. | 174/353 |
| 6,355,878 | B1 * | 3/2002 | Kim | 174/355 |
| 6,600,664 | B2 | 7/2003 | Durr et al. | |
| 6,863,547 | B2 * | 3/2005 | Park | 439/95 |
| 7,781,969 | B2 * | 8/2010 | Cho | 313/582 |
| 2005/0205280 | A1 * | 9/2005 | Fursich | 174/35 GC |
| 2008/0100215 | A1 * | 5/2008 | Cho | 313/582 |
| 2008/0207013 | A1 * | 8/2008 | Ju | 439/66 |
| 2013/0255993 | A1 * | 10/2013 | Hsieh | 174/135 |
| 2013/0258611 | A1 * | 10/2013 | Li et al. | 361/748 |
| 2014/0177186 | A1 * | 6/2014 | Song et al. | 361/753 |

* cited by examiner

*Primary Examiner* — Truc Nguyen

(57) ABSTRACT

An electronic device includes a first housing, a second housing disposed on the first housing, and a connecting component. The connecting component includes a connecting body and an elastic conductive element. The connecting component is located between the first housing and the second housing. The elastic conductive element with an elastic restoring force is movably disposed in the connecting component. When a part of the elastic conductive element protrudes beyond the connecting body, the elastic conductive element is connected to the second housing and the connecting body.

29 Claims, 8 Drawing Sheets

ELECTRONIC DEVICE AND CONNECTING COMPONENT

CROSS-REFERENCE TO RELATED APPLICATIONS

This Application claims priority of Taiwan Patent Application No. 101117972, filed on May 21, 2012, the entirety of which is incorporated by reference herein.

BACKGROUND OF THE INVENTION

Field of the Invention

To protect against electromagnetic interference (EMI) and electrostatic discharge (ESD), an EMI shielding gasket is usually disposed on an electrical connector in an electronic device to electrically connect to the housing of the electronic device. If testing personnel want to know whether the EMI shielding gasket is electrically connected to the electrical connector and the housing correctly or not, the testing personnel need to do a test on the electronic device via a testing apparatus after the electronic device is assembled. If the EMI shielding gasket is not electrically connected to the electrical connector and the housing correctly, the housing must be detached from the electrical connector, and thus a lot of time is wasted. Moreover, since the EMI shielding gasket adheres to the electrical connector or the housing, the EMI shielding gasket may fall on a circuit board of the electronic device and cause an electrical shorting of the circuit board after the EMI shielding gasket is repeatedly pressed.

In addition, if the thickness of the EMI shielding gasket is great, the housing may not completely seal. However, if the EMI shielding gasket is too thin, the EMI shielding gasket may not electrically connect to the electrical connector and the housing, thus increasing the time required for assembly of the electronic device.

BRIEF SUMMARY OF THE INVENTION

To solve the problems of the prior art, the objective of the present invention is to provide an electronic device wherein an electrical connector is electrically connected to a housing after the electronic device is assembled.

For the above objective, the present invention provides an electronic device including a first housing, a second housing, and a connecting component. The first housing is disposed on the second housing, and has an aperture. The connecting component includes a connecting body and an elastic conductive element. The connecting body is located between the first housing and the second housing. The connecting body is a hollow structure having a first opening and a second opening opposite to the first opening. The first opening faces an aperture of the first housing, and the second opening faces the second housing. The elastic conductive element is movably disposed in the connecting body. When a part of the elastic conductive element protrudes beyond the second opening, the elastic conductive element is connected to the second housing and the connecting body.

To meet the above objective, the present invention provides a connecting component electrically connected to a housing. The connecting component includes a connecting body and an elastic conductive element. The connecting body has a first opening, a second opening opposite to the first opening, a first receiving chamber, a second receiving chamber, and a connecting hole. The first receiving chamber communicates with the first opening and the connecting hole, and the second receiving chamber communicates with the second opening and the connecting hole. The elastic conductive element is movably disposed in the connecting body. The elastic conductive element includes a first wide portion, a second wide portion, and a narrow portion. The first wide portion is located in the first receiving chamber. The second wide portion is located in the second receiving chamber. The narrow portion is located in the connecting hole, between the first wide portion and the second wide portion. The first wide portion is moved to the second receiving chamber by a rod element passing through the aperture and the first opening in sequence and pushing the first wide portion. Then, the second wide portion protrudes beyond the second opening and contacts the second housing.

In conclusion, by the elastic conductive element and the connecting body of the connecting component of the present invention, the elastic conductive element is electrically connected to the connecting body and the housing by a rod element pushing the elastic conductive element after the electronic device is assembled. Thus, the time required for assembly of the electronic device is decreased, and the elastic conductive element is retained in the connecting body to prevent the elastic conductive element from falling on the inside of the electronic device.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
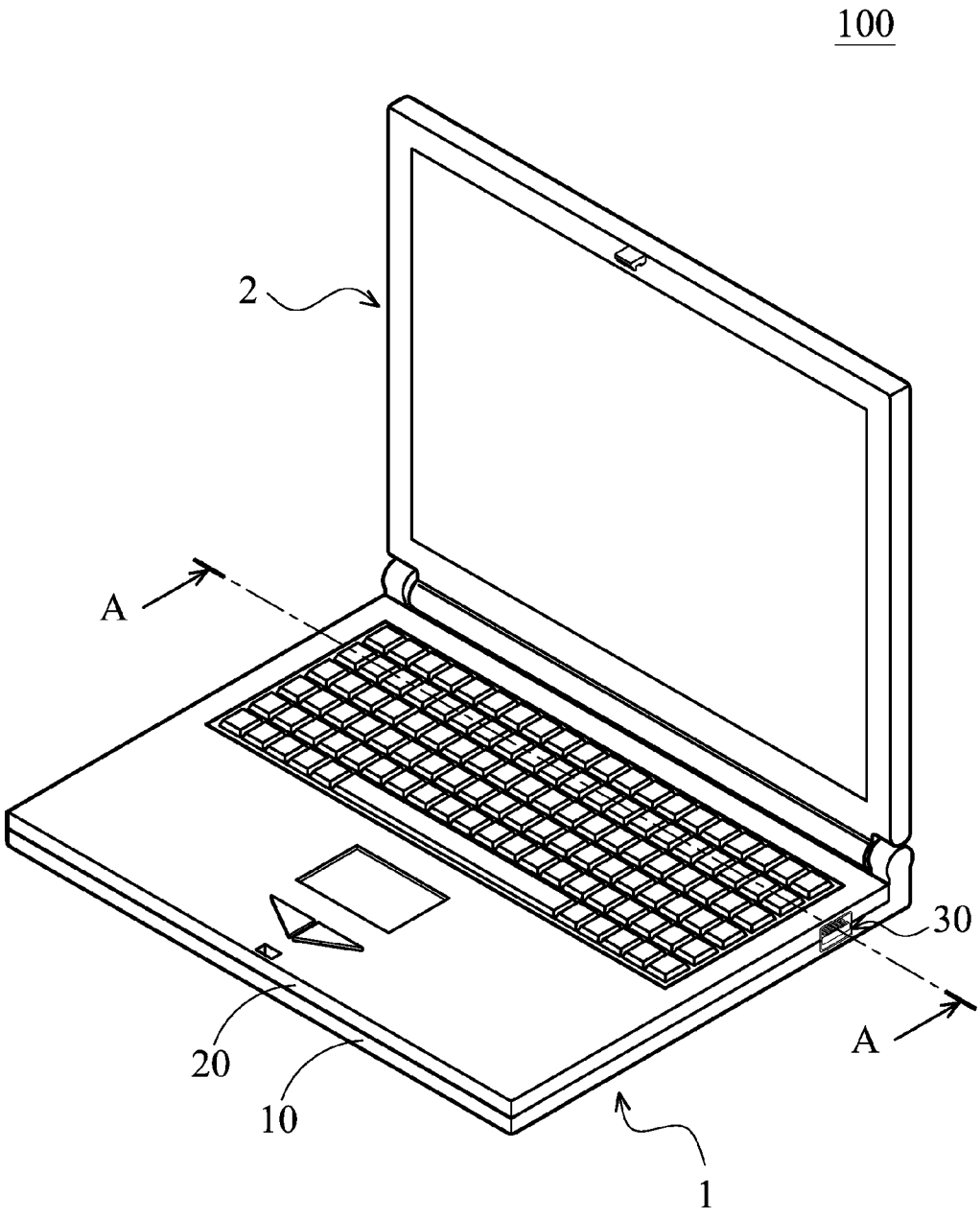
FIG. 1 is a perspective view of an electronic device according to an embodiment of the invention.

FIG. 1 is a perspective view of an electronic device 100 according to an embodiment of the invention. The electronic device 100 may be a notebook computer, but is not limited thereto. For example, in another embodiment, the electronic device 100 may be a tablet personal computer or a smart phone. The electronic device 100 includes a base 1 and a display 2, and the base 1 pivots on the display 2.

Figure 2:
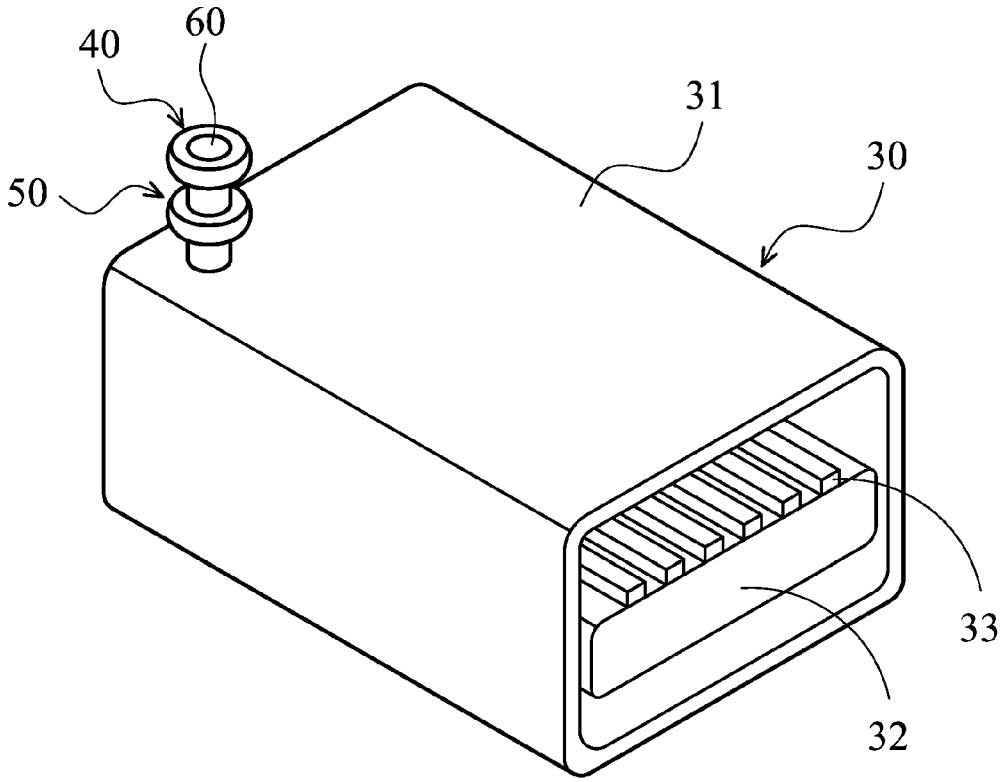
FIG. 2 is a perspective view of an electrical connector and a connecting component according to an embodiment of the invention.
Figure 3:
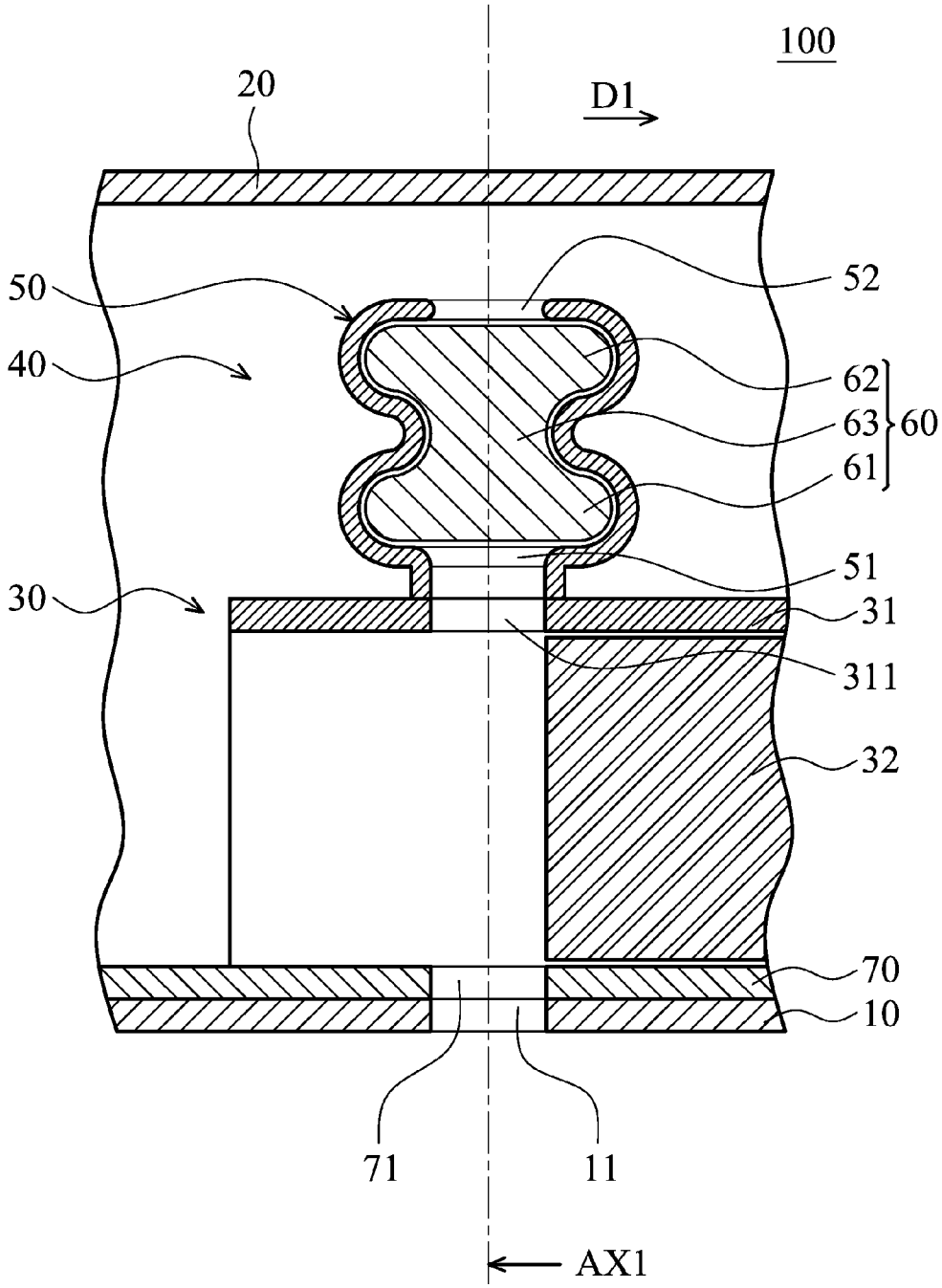
FIG. 3 is a cross-sectional view of cross-sectional line A-A of FIG. 1.

FIG. 2 is a perspective view of an electrical connector 30 and a connecting component 40 according to an embodiment of the invention. FIG. 3 is a cross-sectional view of cross-sectional line A-A of FIG. 1. The base 1 includes a first housing 10, a second housing 20, an electrical connector 30, a connecting component 40 and a circuit board 70. The first housing 10 is disposed on the second housing 20, and has an aperture 11. The electrical connector 30, the connecting component 40 and circuit board 70 are located between the first housing 10 and the second housing 20.

The electrical connector 30 includes a metal housing 31, an insulating body 32 and a plurality of terminals 33. The metal housing 31 has a hole 311. The insulating body 32 is disposed in the metal housing 31, and the terminals 33 are disposed on the insulating body 32, and electrically connected to the circuit board 70.

The connecting component 40 includes a connecting body 50 and an elastic conductive element 60. The connecting body 50 is a hollow structure located between the first housing 10 and the second housing 20. The connecting body 50 is disposed on the metal housing 31. The elastic conductive element 60 is movably disposed in the connecting body 50, and has an elastic restoring force to form an elastic movement state in the connecting body 50.

The circuit board 70 may be a main board, disposed on the first housing 10. The circuit board 70 includes a hole 71 corresponding to the aperture 11, and the hole 71 communicates with the aperture 11. The electrical connector 30 is disposed on the circuit board 70.

Figure 4:
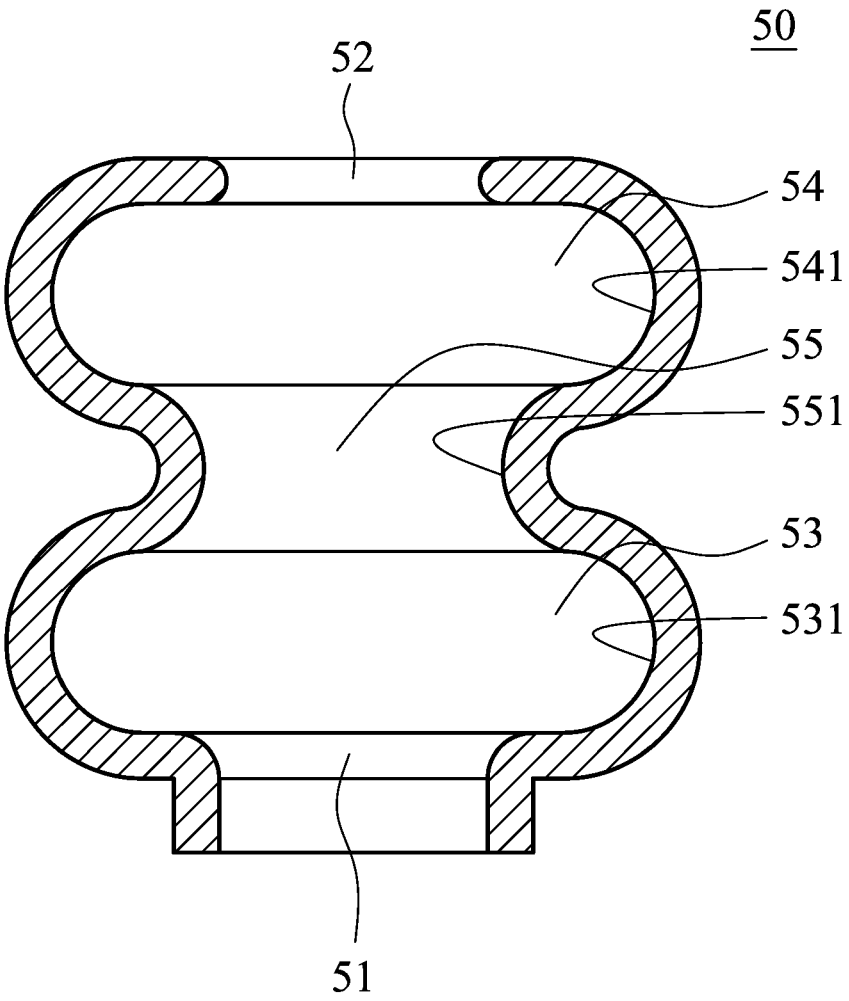
FIG. 4 is a cross-sectional view of the connecting body according to an embodiment of the invention.

FIG. 4 is a cross-sectional view of the connecting body 50 according to an embodiment of the invention. As shown in FIGS. 2 to 4, the connecting body 50 may be an hourglass shaped having a first opening 51, a second opening 52 opposite to the first opening 51, a first receiving chamber 53, a second receiving chamber 54, and a connecting hole 55. The first opening 51 faces the first housing 10, and the second opening 52 faces the second housing 20. The first opening 51 corresponds to the hole 311 and communicates with the hole 311.

The first opening 51, the first receiving chamber 53, the connecting hole 55, the second receiving chamber 54, and the second opening 52 are arranged along an extending axis AX1. The first receiving chamber 53 communicates with the first opening 51 and the connecting hole 55, and the second receiving chamber 54 communicates with the second opening 52 and the connecting hole 55.

The connecting hole 55 is located between the first receiving chamber 53 and the second receiving chamber 54. The narrowest widths of the first opening 51, the second opening 52 and the connecting hole 55 along an extending direction D1, which is perpendicular to the extending axis AX1, are smaller than the widest widths of the first receiving chamber 53 and the second receiving chamber 54 along the extending direction D1. The narrowest widths of the first opening 51, the second opening 52, the connecting hole 55, the holes 71, 311, and the aperture 11 along the extending direction D1 may be the same.

Figure 5:
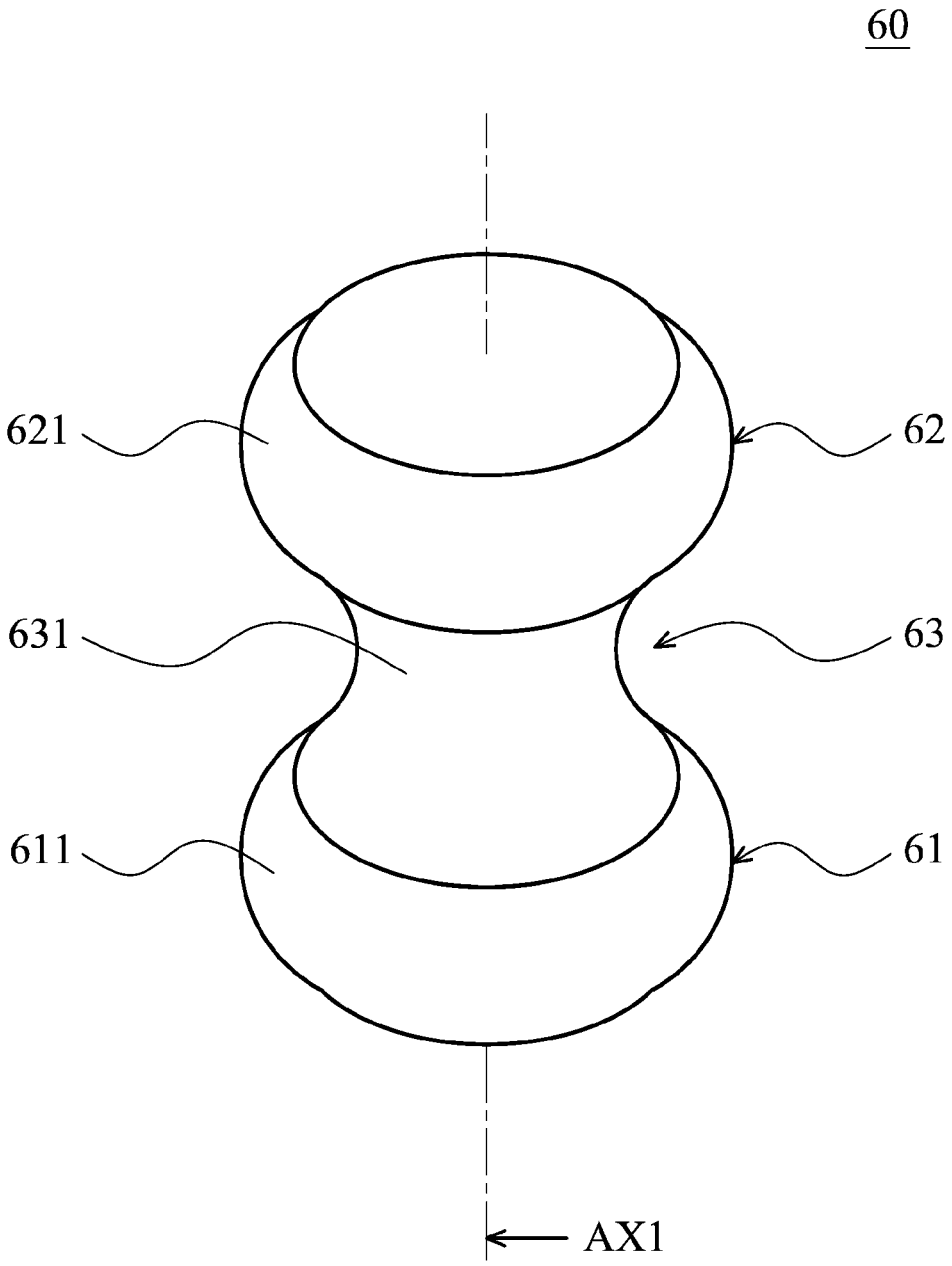
FIG. 5 is a perspective view of the elastic conductive element according to an embodiment of the invention.

FIG. 5 is a perspective view of the elastic conductive element 60 according to an embodiment of the invention. As shown in FIGS. 3 to 5, the elastic conductive element 60 may be a columnar structure with an elastic restoring force. When the elastic conductive element 60 is pressed, the shape of the elastic conductive element 60 is deformed, and then when the elastic conductive element 60 is not be pressed, the shape of the elastic conductive element 60 is restored. In the embodiment, the elastic conductive element 60 may be an EMI shielding gasket.

The elastic conductive element 60 may be hourglass shaped and include a first wide portion 61, a second wide portion 62, and a narrow portion 63. The narrow portion 63 is connected to the first wide portion 61 and the second wide portion 62 and is located between the first wide portion 61 and the second wide portion 62. The first wide portion 61, the narrow portion 63, and the second wide portion 62 are arranged along the extending axis AX1 in sequence. The narrowest width of the narrow portion 63 along the extending direction D1 is smaller than the widest width of the first wide portion 61 and the second wide portion 62 along the extending direction D1. The narrowest widths of the first opening 51, the second opening 52 and the connecting hole 55 along the extending direction D1 are smaller than the widest widths of the first wide portion 61 and the second wide portion 62 along the extending direction D1.

The first wide portion 61, the second wide portion 62, and the narrow portion 63 respectively have ring-shaped arc surfaces 611, 621 and 631 surrounding the extending axis AX1. The first receiving chamber 53, the second receiving chamber 54, and the connecting hole 55 respectively have ring-shaped arc surfaces 531, 541 and 551 surrounding the extending axis AX1, and the arc surface 531, 541 and 551 respectively correspond to the arc surfaces 611, 621 and 631.

In another embodiment, the number of the receiving chamber and the connecting hole of the connecting body 50, and the number of the wide portion and the narrow portion of the elastic conductive element 60 are not limited. The connecting body 50 and the elastic conductive element 60 may be disposed on an inner surface of the metal housing 31 near the position of the insulating body 32.

As shown in FIGS. 3 and 4, a gap is located between the connecting body 50 and the second housing 20. The first wide portion 61 of the elastic conductive element 60 is located in the first receiving chamber 53, the second wide portion 62 is located in the second receiving chamber 54, and the narrow portion 63 is located in the connecting hole 55. Since the widths of the first opening 51, the second opening 52 and the connecting hole 55 are smaller than the widths of the first wide portion 61 and the second wide portion 62, the elastic conductive element 60 may be retained in the connecting body 50, and may not fall out of the connecting body 50 during the assembly process of the electronic device 100.

Figure 6:
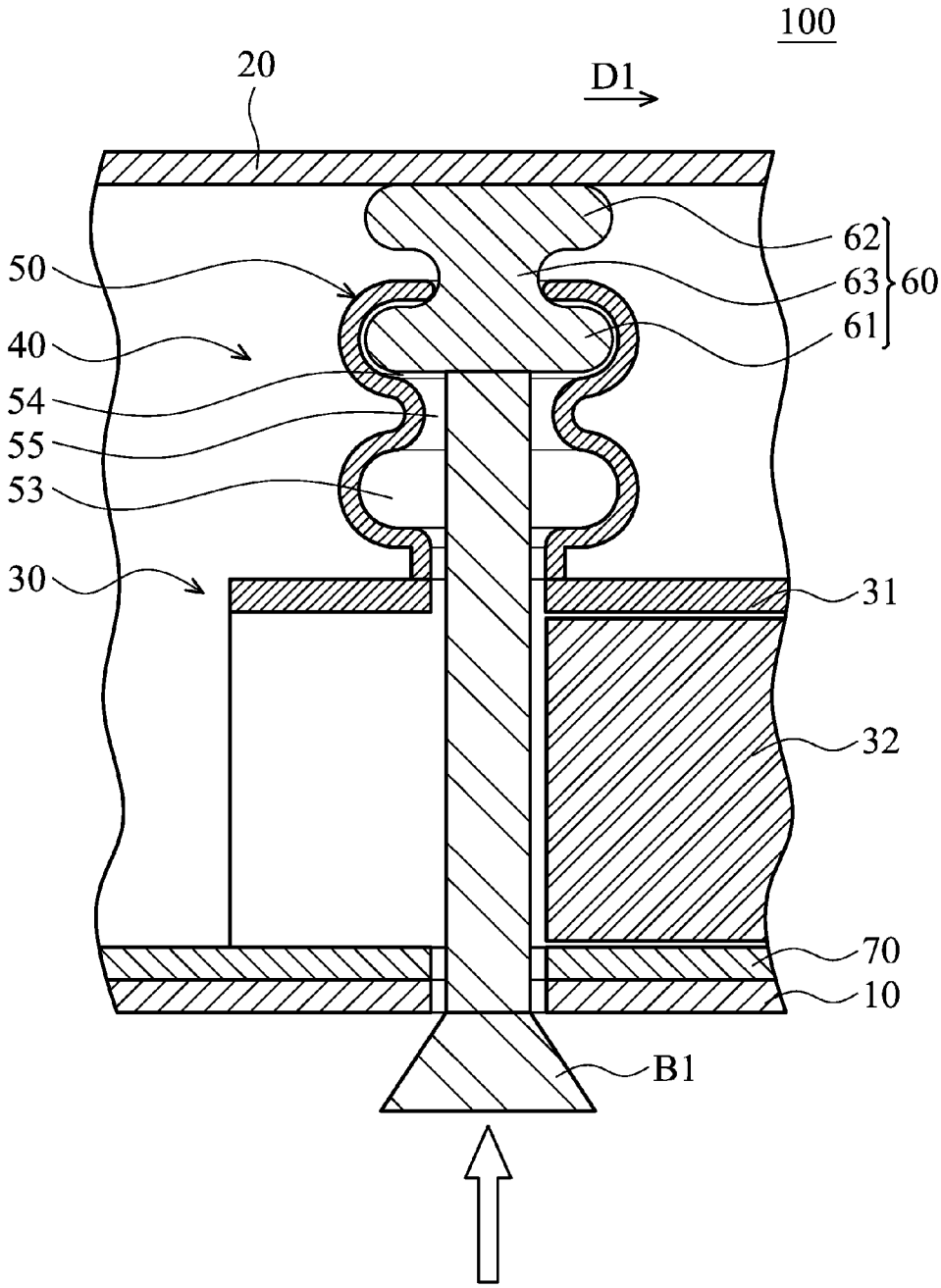
FIG. 6 is a schematic view of the electronic device according to an embodiment of the invention.

FIG. 6 is a schematic view of the electronic device 100 according to an embodiment of the invention. When the electronic device 100 is assembled, testing personnel push the first wide portion 61 with a rod element B1, which passes through the aperture 11 of the first housing 10, the hole 71 of the circuit board 70, the hole 311 of the metal housing 31 and the first opening 51 along the extending axis AX1. Since the widths of the second opening 52 and the connecting hole 55 are smaller than the widths of the first wide portion 61 and the second wide portion 62, the first wide portion 61 is moved from the connecting hole 55 to the second receiving chamber 54 by the deformation of the elastic conductive element 60, and the second wide portion 62 protrudes beyond the second opening 52 and contacts the second housing 20.

After the elastic conductive element 60 is pushed by the rod element B1, the rod element B1 may be removed from the electronic device 100. Since the elastic conductive element 60 is not pushed by the rod element B1, the elastic conductive element 60 is retained in the second receiving chamber 54 due to the elastic restoring force of the elastic conductive element 60. Thus, the elastic conductive element 60 is kept in contact with the second housing 20, and does not fall out of the connecting body 50. In the embodiment, by the elastic conductive element 60 connecting to the second housing 20 and the connecting body 50, the metal housing 31 of the electrical connector 30 is electrically connected to the second housing 20, thus protecting the electrical connector 30 from electromagnetic interference (EMI) and electrostatic discharge (ESD).

Moreover, the structure of the connecting component 40 allows for a greater range of tolerance between the second housing 20 and the connecting body 50. For example, when there is a greater distance between the second housing 20 and the connecting body 50, all or part of the elastic conductive element 60 protrudes beyond the second opening to contact the second housing 20. When there is a shorter distance between the second housing 20 and connecting body 50, the second wide portion 62 is pressed between the second housing 20 and the connecting body 50, and a part of the second wide portion 62 protrudes beyond the second opening 52 to contact the second housing 20.

In the embodiment, if testing personnel find via a testing apparatus that the elastic conductive element 60 is not electrically connected to the second housing 20 and the electrical connector 30, the elastic conductive element 60 can easily be electrically connected to the second housing 20 and the electrical connector 30 by pushing the elastic conductive element 60 with the rod element B1. Thus, the first housing 10 and the second housing 20 detached from the electronic device 100 are not needed. Moreover, in the embodiment, since the thickness of the elastic conductive element 60 may not be adjusted accurately, the time required for assembling the electronic device 100 is reduced.

Figure 7:
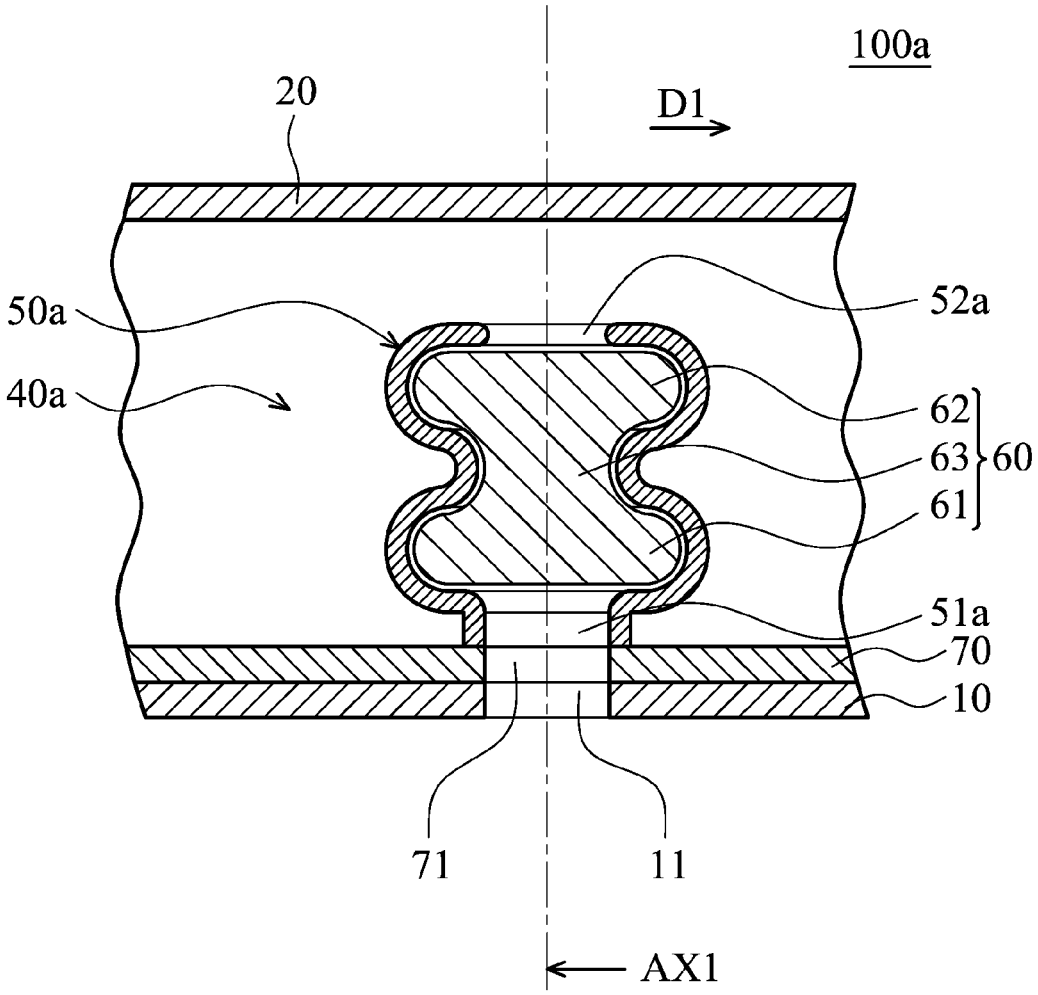
FIG. 7 is a cross-sectional view of another embodiment of an electronic device of the invention.

FIG. 7 is a cross-sectional view of another embodiment of an electronic device 100*a* of the invention. The differences between the embodiment and the described embodiment are described as follows. The connecting body 50*a* of the connecting component 40*a* is disposed on the circuit board 70. The first opening 51*a* of the connecting body 50*a* corresponds to the hole 71 and communicates with the hole 71. By the elastic conductive element 60 contacting the second housing 20, the second housing 20 is electrically connected to the circuit board 70, and the circuit board 70 is protected from electromagnetic disturbances and electrostatic discharge.

Figure 8:
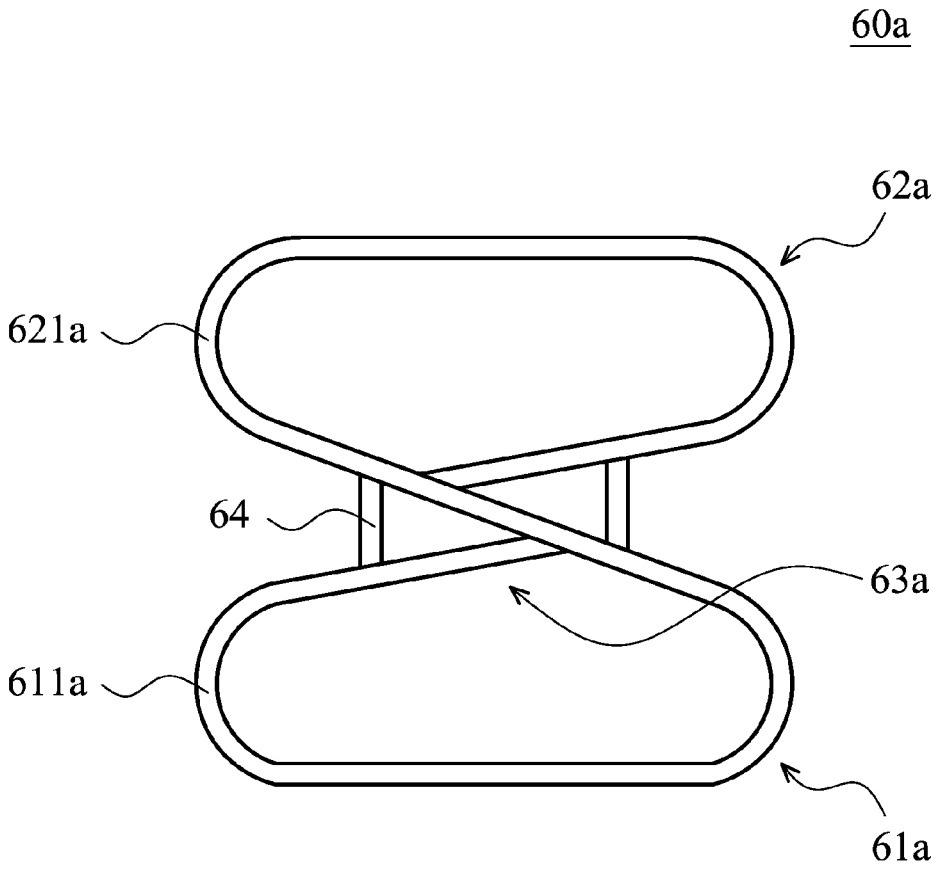
FIG. 8 is a side view of another embodiment of an elastic conductive element of the invention.

FIG. 8 is a side view of another embodiment of an elastic conductive element 60*a* of the invention. The difference between the embodiment and the described embodiment are described as follows. The elastic conductive element 60*a* is a blended metal strip. The elastic conductive element 60*a* includes a first wide portion 61*a*, a second wide portion 62*a*, and a narrow portion 63*a*. The first wide portion 61*a* is a ring-shaped structure with an arc surface 611*a*, and the second wide portion 62*a* is a ring-shaped structure with an arc surface 621*a*.

Moreover, the elastic conductive element 60*a* further includes two retaining elements 64 located between the first wide portion 61*a* and the second wide portion 62*a*. The retaining element 64 may be applied to the described embodiment. The retaining element 64 is connected to the first wide portion 61*a* and/or the second wide portion 62*a* to limit the compression ratio of the elastic conductive element 60*a*. For example, when the compression ratio of the elastic conductive element 60*a* is 30%, the conductivity of the elastic conductive element 60*a* is better. Thus, when the elastic conductive element 60*a* is pressed, the compression ratio of the retaining element 64 is limited to about 30% to force the elastic conductive element 60*a* to have better conductivity.

In conclusion, thanks to the elastic conductive element and the connecting body of the connecting component of the present invention, the elastic conductive element is electrically connected to the connecting body and the housing by a rod element pushing the elastic conductive element after the electronic device is assembled. Thus, the time required to assemble the electronic device may be decreased, and the elastic conductive element is retained in the connecting body to prevent the elastic conductive element from falling on the inside of the electronic device.

While the invention has been described by way of example and in terms of preferred embodiment, it is to be understood that the invention is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a first housing;

a second housing disposed on the first housing; and a connecting component, comprising a connecting body located between the first housing and the second housing, wherein the connecting body is a hollow structure having a first opening and a second opening opposite to the first opening, and the first opening faces the first housing, and the second opening faces the second housing;

an elastic conductive element movably disposed in the connecting body, wherein when a part of the elastic conductive element protrudes beyond the second opening, the elastic conductive element is connected to the second housing and the connecting body.

2. The electronic device as claimed in claim 1, further comprising an electrical connector located between the first housing and the second housing, and the connecting body disposed on the electrical connector.

3. The electronic device as claimed in claim 2, wherein the electrical connector comprises a metal housing having a hole, wherein the connecting body is disposed on the metal housing, and the hole corresponds to the first opening.

4. The electronic device as claimed in claim 1, further comprising a circuit board located between the first housing and the second housing, and the connecting body disposed on the circuit board.

5. The electronic device as claimed in claim 4, wherein the electrical connector comprises a hole corresponding to the first opening.

6. The electronic device as claimed in claim 1, wherein the connecting body further comprises a first receiving chamber, a second receiving chamber and a connecting hole, wherein the first receiving chamber communicates with the first opening and the connecting hole, and the second receiving chamber communicates with the second opening and the connecting hole.

7. The electronic device as claimed in claim 6, wherein the first housing has an aperture, and the first opening faces the aperture.

8. The electronic device as claimed in claim 7, wherein the elastic conductive element comprises:

a first wide portion located at the first receiving chamber;

a second wide portion located at the second receiving chamber; and a narrow portion, located between the first wide portion and the second wide portion, located at the connecting hole;

wherein the first wide portion is moved to the second receiving chamber by a rod element passing through the aperture and the first opening in sequence and pushing the first wide portion, and the second wide portion protrudes beyond the second opening and contacts the second housing.

9. The electronic device as claimed in claim 8, wherein the widths of the first opening, the second opening, and the connecting hole are smaller than the widths of the first receiving chamber and the second receiving chamber.

10. The electronic device as claimed in claim 8, wherein the first opening, the first receiving chamber, the connecting hole, the second receiving chamber, and the second opening are arranged along an extending axis in sequence.

11. The electronic device as claimed in claim 10, wherein the narrowest widths of the first opening, the second opening and the connecting hole along an extending direction perpendicular to the extending axis are smaller than the widest widths of the first receiving chamber and the second receiving chamber along the extending direction.

12. The electronic device as claimed in claim 8, wherein the first wide portion, the narrow portion and the second wide portion are arranged along an extending axis in sequence.

13. The electronic device as claimed in claim 12, wherein a narrowest width of the narrow portion along an extending direction perpendicular to the extending axis is smaller than widest widths of the first wide portion and the second wide portion along the extending direction.

14. The electronic device as claimed in claim 13, wherein the narrowest widths of the first opening, the second opening and the connecting hole along the extending direction are smaller than the widest widths of the first wide portion and the second wide portion along the extending direction.

15. The electronic device as claimed in claim 8, wherein the first wide portion and the second wide portion are ring-shaped structures.

16. The electronic device as claimed in claim 8, wherein the elastic conductive element comprises a retaining element, located between the first wide portion and the second wide portion, to limit a compression ratio of the elastic conductive element.

17. The electronic device as claimed in claim 1, wherein the elastic conductive element is a blended metal strip.

18. The electronic device as claimed in claim 1, wherein the elastic conductive element is an EMI shielding gasket.

19. A connecting component electrically connected to a housing, comprising:

a connecting body having a first opening, a second opening opposite to the first opening, a first receiving chamber, a second receiving chamber, and a connecting hole, wherein the first receiving chamber communicates with the first opening and the connecting hole, and the second receiving chamber communicates with the second opening and the connecting hole; and an elastic conductive element movably disposed in the connecting body, wherein the elastic conductive element comprises a first wide portion located at the first receiving chamber;

a second wide portion located at the second receiving chamber; and a narrow portion, located between the first wide portion and the second wide portion, located at the connecting hole;

wherein the first wide portion is moved to the second receiving chamber by a rod element passing through the first opening and pushing the first wide portion, and the second wide portion protrudes beyond the second opening and contacts the second housing.

20. The connecting component as claimed in claim 19, wherein widths of the first opening, the second opening, and the connecting hole are smaller than widths of the first receiving chamber and the second receiving chamber.

21. The connecting component as claimed in claim 19, wherein the first opening, the first receiving chamber, the connecting hole, the second receiving chamber, and the second opening are arranged along an extending axis in sequence.

22. The connecting component as claimed in claim 21, wherein the narrowest widths of the first opening, the second opening and the connecting hole along an extending direction perpendicular to the extending axis are smaller than the widest widths of the first receiving chamber and the second receiving chamber along the extending direction.

23. The connecting component as claimed in claim 19, wherein the first wide portion, the narrow portion and the second wide portion are arranged along an extending axis in sequence.

24. The connecting component as claimed in claim 23, wherein the narrowest width of the narrow portion along an extending direction perpendicular to the extending axis is smaller than the widest width of the first wide portion and the second wide portion along the extending direction.

25. The connecting component as claimed in claim 24, wherein the narrowest widths of the first opening, the second opening and the connecting hole along the extending direction are smaller than the widest widths of the first wide portion and the second wide portion along the extending direction.

26. The connecting component as claimed in claim 19, wherein the elastic conductive element is a blended metal strip.

27. The connecting component as claimed in claim 26, wherein the first wide portion and the second wide portion are ring-shaped structures.

28. The connecting component as claimed in claim 19, wherein the elastic conductive element is an EMI shielding gasket.

29. The connecting component as claimed in claim 19, wherein the elastic conductive element comprises a retaining element, located between the first wide portion and the second wide portion, to limit a compression ratio of the elastic conductive element.

* * * * *